United States Patent [19]

Dittmann

[11] 3,931,671

[45] Jan. 13, 1976

[54] TERMINAL LOCATOR AND RETAINER DEVICE

[75] Inventor: Larry Eugene Dittmann, Harrisburg, Pa.

[73] Assignee: AMP Incorporated, Harrisburg, Pa.

[22] Filed: Sept. 30, 1974

[21] Appl. No.: 510,338

[52] U.S. Cl. ..... 29/203 DT; 29/203 J; 29/203 P; 72/461; 269/287; 269/305; 269/321 WE

[51] Int. Cl.[2] ..... H01R 43/04

[58] Field of Search ..... 29/203 DT, 203 DS, 203 D, 29/203 J, 203 P, 628; 269/321 WE, 287, 303, 305; 72/461

[56] References Cited

UNITED STATES PATENTS

| | | | |
|---|---|---|---|
| 3,553,814 | 1/1971 | Rider | 29/203 DT |
| 3,570,097 | 3/1971 | Bowden, Jr. et al. | 29/203 DT |
| 3,813,753 | 6/1974 | Miller | 29/203 DT |
| 3,839,776 | 10/1974 | Anderson et al. | 29/203 DT |

FOREIGN PATENTS OR APPLICATIONS

| | | | |
|---|---|---|---|
| 186,022 | 11/1906 | Germany | 269/303 |

*Primary Examiner*—Carl E. Hall

*Attorney, Agent, or Firm*—Allan B. Osborne, Esquire

[57] ABSTRACT

This invention relates to a terminal locator and retainer device for use in crimping dies. More particularly the device consists of a molded block of resilient material which contains locating means for accurately positioning the terminal and retaining means for holding the terminal and wire being terminated without need for external support. Further, the device provides a dynamic means for preventing terminal bowing.

6 Claims, 6 Drawing Figures

TERMINAL LOCATOR AND RETAINER DEVICE

BACKGROUND OF THE INVENTION

The termination of wire into an open barrel terminal utilizing a conventional "F" type crimp on top of the terminal and highly deforming the underside simultaneously by means of a raised bar on the anvil presented serious problems. First, there was no way to hold the terminal and wire except by hand. As the nest descended its force easily overcame the stabilizing force of the operator with the result that the terminal twisted and the crimp was either totally lost or very poor. Secondly, there was no way of accurately positioning the terminal with respect to the anvil and nest. Thirdly, the wire had to be held by hand in the barrel, during the crimping operation. This of course subjected the operator to injury to his hand or fingers.

Accordingly, the object of the present invention was to provide a means which could hold the terminal without human aid.

Another object of the present invention was to provide a means which would automatically position the terminal into correct alignment with the die members.

Yet another object of the present invention was to provide means which would hold the terminal in correct alignment during the crimping and deforming operation.

Still another object of the present invention was to provide means which would hold the wire in correct alignment with respect to the wire barrel during crimping operations without requiring operator assistance.

These and other objects were achieved in the present invention which includes a terminal locator and retainer device consisting of a body having a tongue receiving slot and an integral spring member which permits the terminal to be moved vertically generally uniformly.

DESCRIPTION OF THE PREFERRED EMBODIMENT

Figures 1, 2:
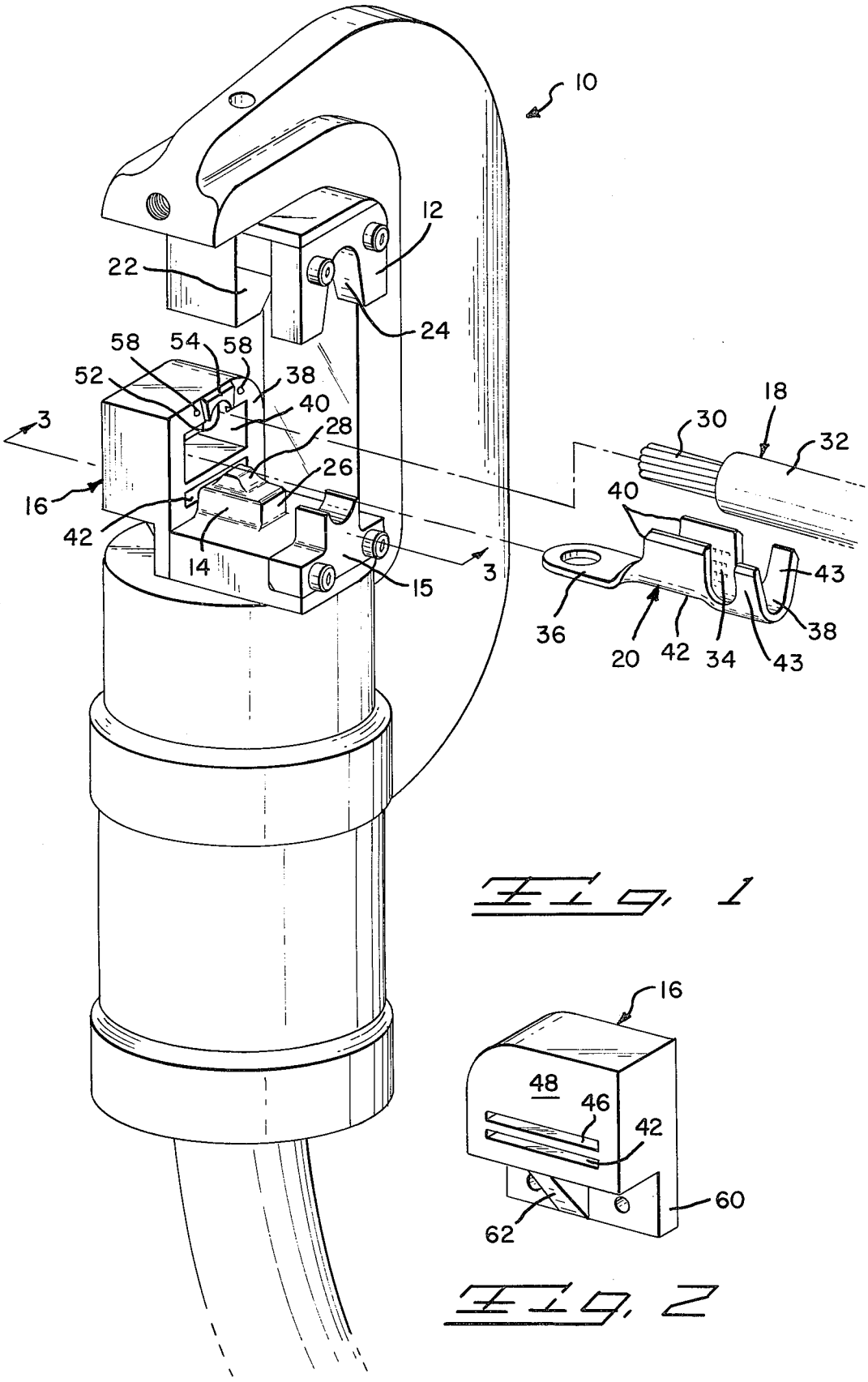
FIG. 1 illustrates the utility of the present invention.
FIG. 2 is a perspective view of the back side of the present invention.

Referring now to the drawings wherein like reference numerals represent corresponding parts in all Figures, there is shown in FIG. 1 a conventional hydraulically-operated crimping press 10 containing a nest 12, anvil 14; i.e., the crimping dies, an insulation support member 15 and the terminal locator and retainer device 16, hereinafter sometimes referred to simply as retainer device 16 or device 16.

A wire 18 and open barrel terminal 20 is shown to the right of press 10.

Nest 12 consists of the wire barrel crimping portion 22 and insulation crimping portion 24.

Anvil 14 is characterized by its wire barrel support 26 and the high deformation bar 28 which rests on support 26.

Wire 18 contains a conductor 30 which may be solid or stranded as shown, and an insulation jacket 32. The wire has been prepared for terminating by exposing the portion of the conductor which will be received in wire barrel 34 of terminal 20.

In addition to wire barrel 34, terminal 20 consists of a tongue 36 and, at the other end, insulation barrel 38.

Wire barrel 34 is characterized by two upwardly diverging side walls 40 connected at the base by an arcuate floor 42. The inside of the floor and walls may contain indentations. The insulation barrel, which also has two side walls 43, is displaced downwardly relative to the wire barrel to adjust for the insulation jacket thickness.

Terminal locator and retainer device 16 may be molded with the preferred material being polyurethane rubber. The front face 38 contains a large opening 40 and a narrow, horizontal slot 42 just beneath. Slot 42 extends through the body and opens out onto the back side.

Figure 3:
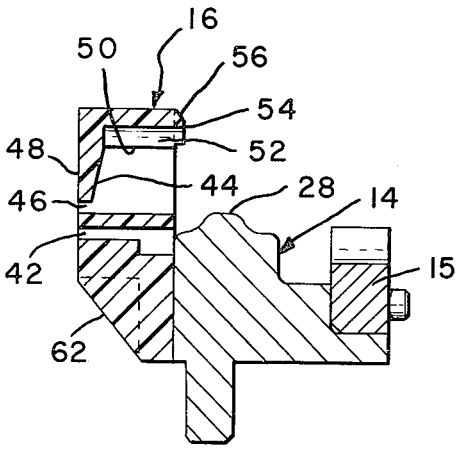
FIGS. 3–6 are cross-sectional views, taken along lines 3—3 of FIG. 1, showing sequentially the positioning and crimping of a terminal and wire utilizing the present invention.

The back wall 44 of opening 40, seen in FIG. 3, slopes rearwardly from the top wall and ends spaced above the floor to define a narrow horizontal slot 46 which opens out onto the back side 48 of the retainer device (FIG. 2).

The top wall 50 of the opening contains an arcuate groove 52.

On the portion of the front face 38 running across the top of opening 40 and in the center thereof is a forwardly extending projection 54 which provides the locating and positioning means for terminal 20. The width of projection 54 is equal to the space between the side walls 40 of terminal 20 at their free ends. The sides of the projection taper inwardly as shown in FIG. 1 to reflect the slanted side walls 40. The upper surface 56 of the projection is beveled as may be seen in the cross-sectional views 3–6.

A pair of raised dots 58, positioned on the front face 38 of the retainer, one on each side of projection 54, provide guide means for placing the terminal.

The lower portion of retainer device 16 is cut away to provide a thin downwardly depending mounting flange 60 as seen in FIG. 2. A brace 62 resiliently supports the rear upper portion of the retainer device.

Figure 4:
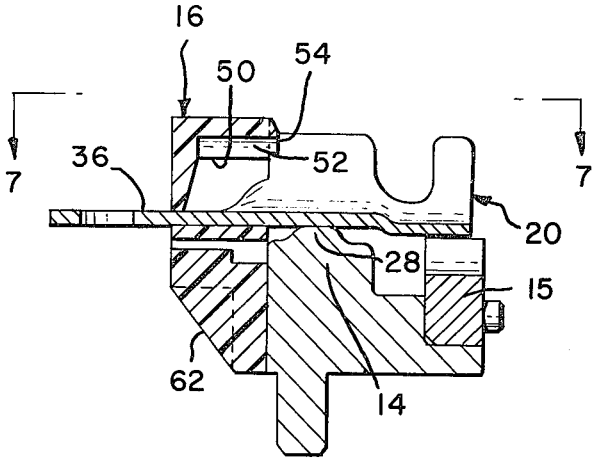
Figure 6:
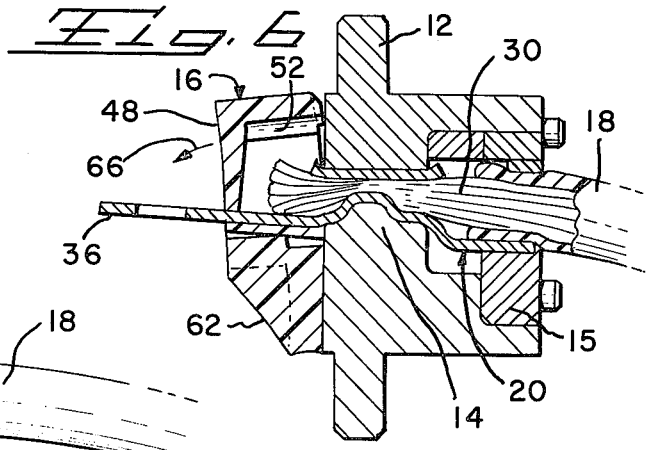
Figure 5:
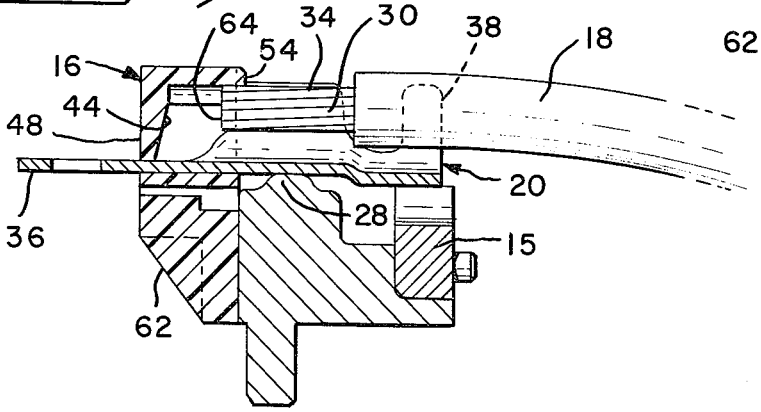

The method of utilizing the terminal locator and retainer device 16 is shown sequentially in the cross-sectional views, FIGS. 4–6. Beginning with FIG. 4, the tongue 36 of terminal 20 is shoved against the sloping rear wall 44 which guides it down into slot 46. This slot is slightly undersized relative to the thickness of the tongue so that it frictionally holds the terminal. The leading edges of the wire barrel side walls 40 abut the front face 38 of the retainer, one wall on either side of projection 54. Between slot 46 and projection 54, terminal 20 is securely held against axial, lateral or rotational movement. Further, the terminal is in alignment with the anvil and nest with floor 42 of the wire barrel resting on top of bar 28. The retention is so firm that the operator's hands are completely freed.

If, during the step of inserting the tongue 36 into opening 40 and slot 46, the terminal had been canted to one side or the other, the aforementioned raised dots would have caused the terminal to veer over into correct alignment or, in the case where the cant angle was too high, would have let the terminal abut up against the face at such a cocked angle that it would be immediately apparent that the positioning of the terminal was incorrect. In other words, by virtue of the raised dots 58 and projection 54, the terminal is located on the anvil either precisely correct or very obviously incorrect.

Moving to FIG. 5, prepared wire 18 is located so that the tip 64 of conductor 30 enters groove 52 and the remaining bared portion rests in wire barrel 34. The weight of the wire forces tip 64 up against the groove surface and in that manner the wire is held in place without any other support. The covered wire behind the bared conductor rests in insulation barrel 38.

FIG. 6 is a view taken at the point where anvil 14 has moved up into engagement with nest 12. As the anvil approaches the nest, the beveled upper surface 56 of projection 54 strikes the nest and retainer device 16 is cammed backward and downward in the direction indicated by arrow 66. This rotational motion is necessary first to remove the projection 54 and raised dots 58 out of the way of the nest; i.e., these projections would otherwise be in the crimp area and obviously sheared off by the nest. Secondly, under the crimping force applied, conductor 30 and wire barrel 34 are significantly enlarged axially; i.e., the conductor and wire barrel are extruded into opening 40. The rotational movement provides increased axial length in the opening for this extrusion. Additionally, the rotational movement provides a benefit in that the walls surrounding tongue 36 are compressed and the terminal is held more firmly during the critical crimping operation.

The presence of bar 28 on anvil 14 results in a high degree of compression between the conductor and wire barrel. In the case of a stranded conductor, inter-strand cold welding occurs which greatly enhances the conductivity of the termination. However, the presence of the bar introduces an undesirable affect of axially bowing the terminal about the wire barrel. To prevent bowing, means must be provided which allows the terminal 20 to displace vertically, relative to anvil 14, a distance equal to the height of bar 28 and thereafter provides firm support during the remaining crimping action. The present invention provides the means for accomplishing these objectives in this manner. Referring to FIG. 5, the floor of opening 40 - slot 46 is on the same plane as the top of bar 28, and the top wall of slot 42 is on the same plane as the top of anvil 14. Now referring back to FIG. 6, tongue 36 has been vertically displaced so that it is on approximately the same plane as anvil 14. The void defining slot 42 and the resiliency of the material separating that slot and slot 46 permits this downward displacement. Over travel of the terminal tongue is prevented by the firm support provided by the floor of slot 42 buttressed by brace 62.

After side walls 40 and 43 have been crimped into encompassing engagement with conductor 30 and wire 18, and the wire barrel 34 deformed by bar 28, the anvil 14 is withdrawn from nest 12. With the pressure relased therefrom, retainer device 16 rotates back up to its normal position shown in FIGS. 1–5 and the terminated wire and terminal may now be withdrawn from locator and retainer device 16.

The foregoing detailed description has been given for clearness of understanding only, and no unnecessary limitations should be understood therefrom, as some modifications will be obvious to those skilled in the art.

I claim:

1. A terminal locator and retainer device for locating and retaining a terminal having a projecting tongue or the like in crimping means comprising: a block of deformable material having retaining means for removably receiving and frictionally retaining the tongue of a terminal and locating means for locating and positioning the terminal to a position on top of a bar-containing-anvil in the crimping means and further having wire retaining means for removably receiving and retaining a wire which may be terminated in the terminal.

2. The terminal locator and retainer device of claim 1 wherein the retaining means include an expandable slot in the block for slidingly receiving the tongue of the terminal, said slot being of lesser size than the thickness of the tongue.

3. The terminal locator and retainer device of claim 1 wherein the locating means include a projection on one face of the block, said projection having downwardly converging sides adapted to engage the inside surfaces of the side walls on the terminal thereby positioning the terminal in a predetermined location.

4. The terminal locator and retainer device of claim 3 wherein the locating means further include a raised dot positioned on each side of the projection, said dots adapted to guide the side walls of the terminal into proper engagement with the projection.

5. The terminal locator and retainer device of claim 1 wherein the wire retaining means include an opening in one face of the block for receiving the end of the wire which may be terminated in the terminal.

6. The terminal locator and retainer device of claim 1 further having a slot of predetermined height located below the retaining means and spaced therefrom by a deformable layer of resilient material, said material adapted to be moved in a vertical direction into the slot so that the terminal is displaced vertically on a generally uniform plane during the crimping thereof so that one end of the terminal does not become bowed in relation to another end.

* * * * *